US005908050A

United States Patent [19]

Froment et al.

[11] Patent Number: 5,908,050

[45] Date of Patent: Jun. 1, 1999

[54] ACTUATOR SPACING FOR PIVOTING ARMS OF A ROTARY DOBBY

[75] Inventors: Jean-Paul Froment, Doussard; Jean-Pierre Pages, Faverges, both of France

[73] Assignee: Staubli Faverges, Faverges, France

[21] Appl. No.: 08/990,785

[22] Filed: Dec. 15, 1997

[30] Foreign Application Priority Data

Dec. 31, 1996 [FR] France ..... 96 16391

[51] Int. Cl.[6] ..... D03C 1/00

[52] U.S. Cl. ..... 139/66 R; 139/76; 74/567

[58] Field of Search ..... 139/66 R, 76, 139/68; 74/567

[56] References Cited

U.S. PATENT DOCUMENTS 4,461,325 7/1984 Palau et al. ..... 139/76
4,544,000 10/1985 Bourgeaux .
4,643,231 2/1987 Brock et al. ..... 139/76
4,858,655 8/1989 Palau et al. ..... 139/76

FOREIGN PATENT DOCUMENTS 2540524 8/1984 France .

*Primary Examiner*—Andy Falik
*Attorney, Agent, or Firm*—Dowell & Dowell, P.C.

[57] ABSTRACT

A rotary dobby which includes pivoting arms which are moveable with respect to a plate connected to an element for actuating a heddle frame in controlled response to a reading-in device and wherein the pivoting arms include catches which are engageable with respect to first and second spaced binding surfaces of the plate in such a manner that one of the arms is spaced from an actuator associated with the reading-in device when the pivoting arms are engaging the binding surfaces.

7 Claims, 3 Drawing Sheets

6a
6
100
5
4
19
17
8
9
8a
10
7a
12
11
13
14
16''
16a
16
16'
14
13
12
11
20
17
18a
20
3'
1
D1
D2
X-X'
2
3
15
F
F'
7a
7

ACTUATOR SPACING FOR PIVOTING ARMS OF A ROTARY DOBBY

BACKGROUND OF THE INVENTION

1. Field of the Invention

This invention relates to a rotary dobby for the operation of the heddle frames installed on a loom and a weaving loom and to a loom provided with such a dobby.

2. Description of the Related Art

It is known that in rotary dobbies the vertical movement of the heddle frames is provided by oscillating components that can be constituted, depending on the case, by connecting rod-arm assemblies or by roller-bearing arms; these oscillating parts are driven by actuating elements in the form of an eccentric gear in the first case or of a cam in the second one. These actuating elements are mounted on a main shaft of the mechanism that is actuated by an intermittent rotary movement and, at the time of each stoppage, as a matter of fact at all the half turns of the above-mentioned shaft, the reading-in device must interlock the actuating element either with the shaft, in order to drive the oscillating part, or with a stationary point in order to effect the angular immobilization of the latter; this interlocking must be effected at each of the heddles of the dobby, that is to say of the actuating unit associated with each heddle frame and depending on the design or pattern to be obtained on the loom during the weaving process.

This selective interlocking is generally obtained by means of a cotter or catch-shaped movable coupling element subjected to the action of two pivoting arms arranged on one and the other sides of the shaft in order to actuate this moveable element at its two stop positions, being each pair of pivoting arms controlled by the reading-in device of the dobby.

In patent application FR-A-2 540 524 was disclosed a rotary dobby for looms in which a plate joined to each heddle frame is comprised of two diametrically opposed notches suitable to interact with the catch of two pivoting arms that are controlled by the reading-in device. These two notches are of different shape because one of them must be relatively deep in order to provide the plate with a perfectly precise angular position and then ensure an adequate holding for as long as necessary. On the other hand, the other notch is of reduced depth and is provided with lateral walls which are wide open and that run parallel to the chamfers of the extremities of the sides of the catch of each pivoting arm, so that the arm's catch can be automatically driven with the rotation of the plate, without the actuating of the reading-in device upon the arm. In this second case, one talks about a "passive" engaging of the catch in the notch.

Tests have shown that such an arrangement functions in a satisfactory manner. In this known device, however, when, depending on the pattern of the loom that is being woven, it is not necessary to exert on the coupling pawl a force causing it to actuate, the tappet of the reading-in device must be deflected towards the arm of which the catch is in passive engagement with the notch of the plate diametrically opposed to it, which allows the actuating of the pawl. Thus, in approximately 50% of the cases, the arm that is in a passive engagement with one of the notches of the plate is actuated although this is not necessary for a good operation of the dobby of the invention.

An excessive energy consumption of the dobby, a high noise level and repeated mechanical stresses on the components of the dobby are elements that are certainly not beneficial for the functioning of the mechanism. In view of these repeated stresses, the dimensioning of the drive shafts, of the flanges and of the reading-in device's tappet gave rise to their high cost and considerable size.

SUMMARY OF THE INVENTION

This invention has the purpose of remedying these shortcomings with the aim of facilitating the construction of a rotary dobby operating with an optimal energy consumption and generating not much noise while its cost price is lower than that of the rotary dobbies of known design.

With this in mind, the present invention relates to a rotary dobby for a weaving loom that comprises at each of its shafts an oscillating element that is coupled to a heddle frame and connected to an actuating element loosely mounted on a main shaft of the dobby, a moveable coupling mechanism resting on a plate that is laterally solid with an actuating element, this moveable mechanism being subjected to elastic means to effectuate the angular connection of the plate with a disk firmly attached to the shaft, and two pivoting arms subjected to the action, on one hand, of the reading-in device and, on the other hand, to the action of the elastic means that function to engage the catches of the arms with one of the two binding surfaces of the plate. This dobby is characterized by the fact that when the arms are engaged with the binding surfaces, one of the arms is outside of the reach of an actuator belonging to the mentioned reading-in device.

Thanks to the invention, when the actuator or tappet of the reading-in device is deflected towards an arm that is out of reach, there is no physical contact between their respective surfaces, so that the arm and the actuator are not subjected to the impacts that could cause fatigue of their respective constituent materials. Furthermore, considering from a statistical viewpoint the multiple head shafts belonging to a dobby, one can count on that approximately 50% of them are in such a position that the arm positioned on the side of the coupling pawl must not be actuated so that, thanks to the invention, in approximately 50% of the cases no arm is displaced by the actuator. Thus, the present invention allows to anticipate a lower energy consumption of the dobby than for dobbies of the hitherto known design, in which at each half-turn of the main shaft one must systematically displace an arm for each heddle frame.

In accordance with an advantageous embodiment of the invention, the plate bears a radial extension defining a first binding surface, separated from the axis of rotation of the shaft at a distance that is greater than the distance separating from this axis of rotation a second binding surface on the plate, diametrically opposite to the first binding surface on the plate. Than to this aspect of the invention, the release from the bearing surface of the arm interacting with the first binding surface is carried out in a very simple manner, by making it rotate around its axis in such a manner that its drive rod is separated from the tappet or the actuator of the reading-in device. Thus, the invention takes advantage of the preexisting elements or components of the dobby in accordance with the invention, including those of the known dobbies, so that the invention can be fashioned in a very economical manner at the cost of slight modifications, that is to say, by increasing the distance of one of the binding surfaces with respect to the main shaft of rotation of each plate of the dobby.

In accordance with another advantageous aspect of the invention, the first binding surface is a passive binding surface of the plate whereas the second binding surface is an active binding surface controlled by the plate. Thanks to this aspect of the invention, the arm engaged with the passive binding surface is that which is free of the bearing surface of the tappet or actuator of the reading-in device.

In accordance with another advantageous aspect of the invention, the catch of each pivoting arm has an external bearing surface and an internal bearing surface, which bearing surface) have vertex angles of different values. Thanks to this aspect of the invention, the amplitude of the angular movement of each arm can be designed so that it is less than that which would be necessary if the bearing surfaces of the catches would interact respectively with the two binding surfaces, having heights that must be added up.

Lastly, the invention relates to a loom provided with a dobby as described above.

The invention will be better understood and its other advantages will be seen more clearly through the below description of two embodiments of a dobby in accordance with its principle, given only by way of example and making reference to the accompanying illustrations wherein:

DESCRIPTION OF THE PREFERRED EMBODIMENT

DESCRIPTION OF THE PREFERRED EMBODIMENT

Figure 1:
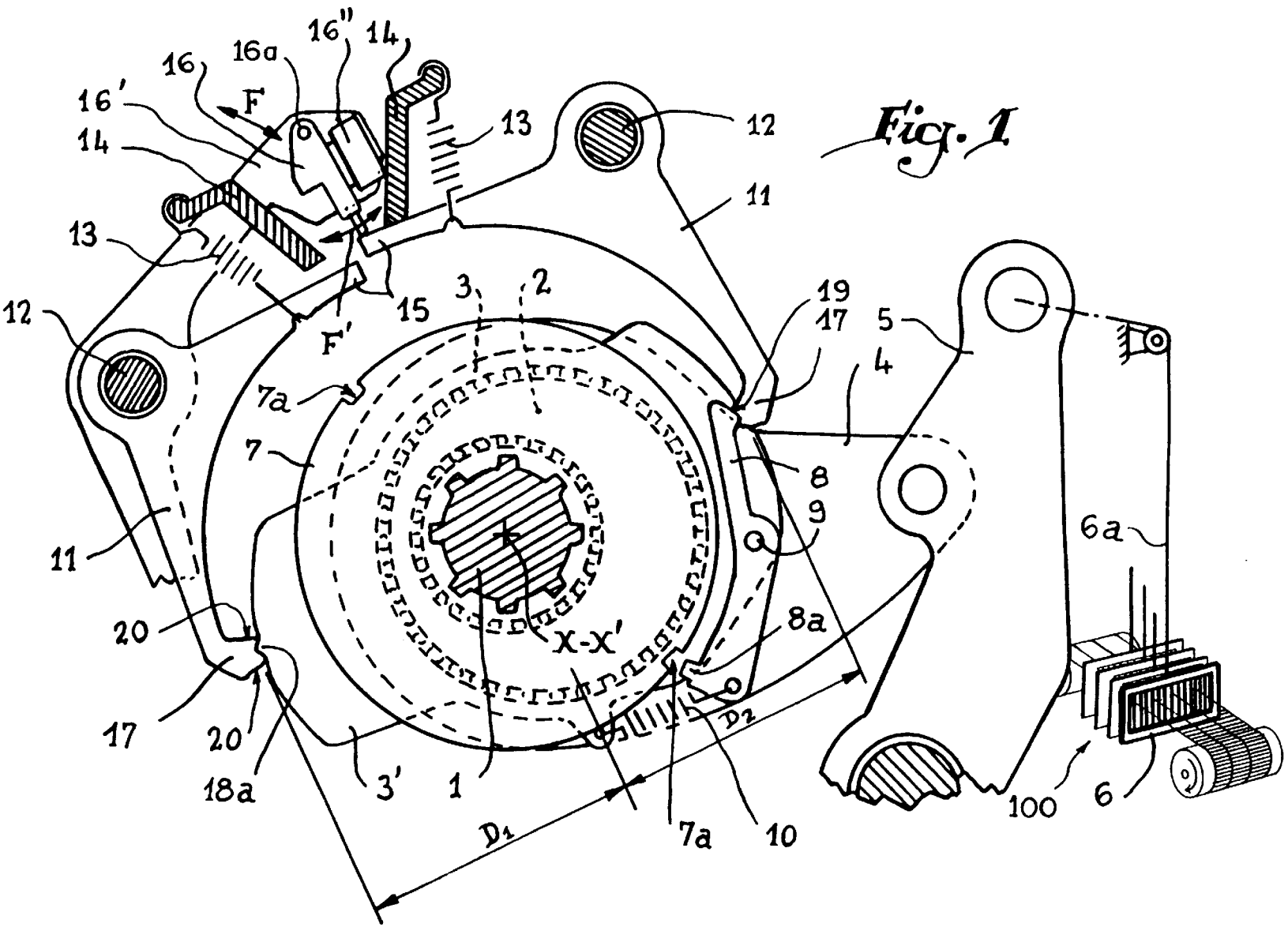
FIG. 1 shows a schematic cross section of a dobby in accordance with the present invention.
Figure 2:
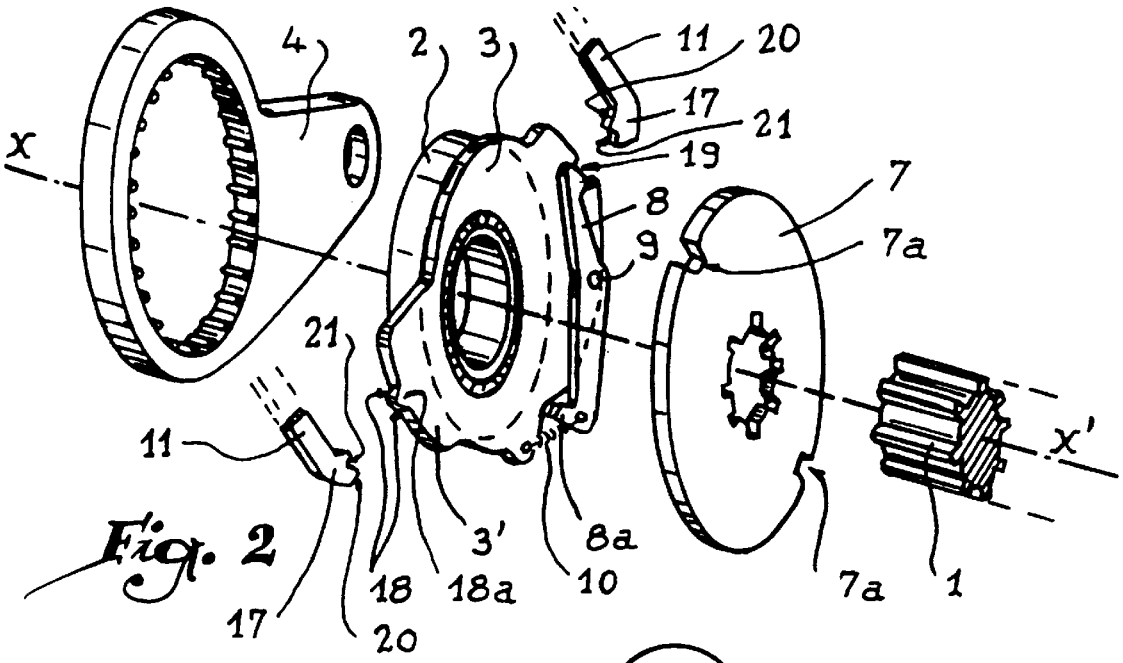
FIG. 2 is a view in perspective showing in a disassembled state the essential constituting elements of one of the heddles of the dobby in accordance with FIG. 1.

The dobby illustrated in FIG. 1 comprises a main shaft 1 driven by an intermittent rotary motion with stops every half turn. This shaft 1 is provided with a number of bearings, which number is equal to that of the heddle frames of the loom. On each bearing is loosely mounted an eccentric gear 2 that is laterally solid with a plate 3. On each eccentric gear 2 is loosely mounted the opening of a connecting rod 4 of which the free end is linked to a pivoting arm 5 which, thanks to a wire 6*a,* causes the vertical movement of the heddle frame 6 of the considered heald shaft, represented in a very schematic manner.

Between two adjacent eccentric gears 2, the groove shaft 1 bears a drive disk 7 that is firmly attached to it and presents on its periphery two radial notches 7*a* that are diametrically opposed to each other. These notches 7*a* are intended to selectively engage the terminal pawl 8*a* of a catch 8 mounted to a spindle 9 affixed to the lateral plate 3 of the corresponding eccentric gear 2. A spring 10 continuously releases the pawl 8*a* from the catch 8 towards the shaft 1.

The control of each catch 8 is carried out by means of two pivoting arms 11 linked to stationary spindles 12 running parallel to the shaft 1. Each arm 11, taken as a whole, had a square profile and is acted upon by a spring 13 in order to come to rest against a corresponding stationary stop 14. Each arm 11 is provided with a drive rod 15 susceptible to be selectively controlled by the tappet or actuator 16 belonging to the reading-in device of the dobby.

The tappet 16 is mounted on a pivot member 16' driven by a back and forth motion by pivoting around the stationary spindle 12 of one of the arms 11, by way of example, activated by a not represented cam mechanism. The pivot member 16' can also by designed in such a manner that it is linked to a spindle other than spindle 12. The back and forth motion or "hammer motion" of the pivot member 16' is indicated by the arrow F in FIG. 1. At each half turn of the shaft 1, the tappet 16 is displaced towards the rods 15 of the arms 11. By means of a control element 16", e.g., electromagnetic, is it possible to have the tappet 16 pivot on its coupling spindle or pivot 16*a* of the pivot member 16'. This drive is shown by the arrow F' in FIG. 1.

Figure 3:
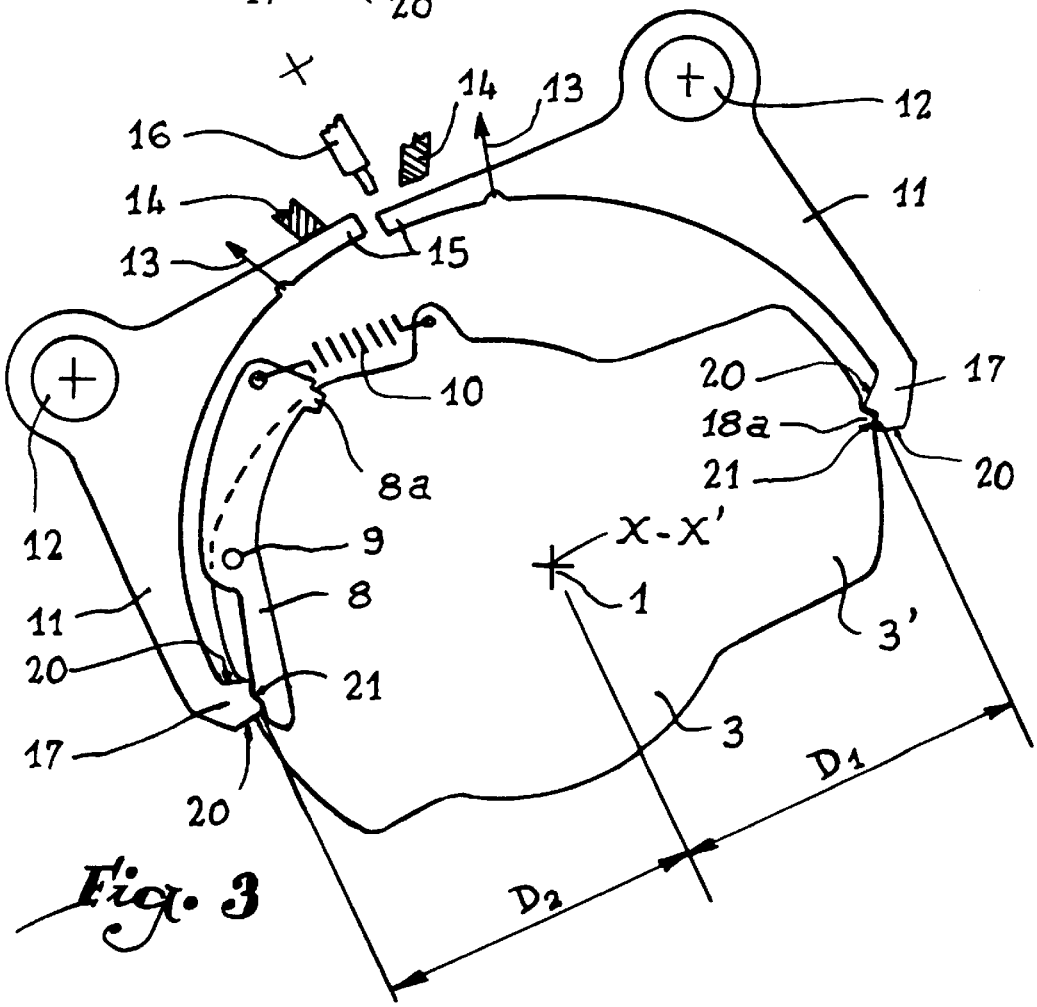
FIG. 3 is a simplified cross section similar to FIG. 1, wherein the dobby is in a 180° shifted position with respect to FIG. 1.

Opposite to its rod 15, each arm 11 is provided with a catch 17 susceptible to interact with two binding surfaces 18 and 19 arranged at the periphery of the plate 3. Thanks to the catches 17 and to the binding surfaces 18 and 19, the plate 3 can thus be immobilized in two positions separated by a 180° rotation of the plate 3 depending on whether the catch 17, shown at the left in FIG. 1, interacts with the surface 18 while the catch 17, shown at the right, interacts with the surface 19 (FIG. 1), or whether the catch 17, shown at the left, interacts with the surface 19 while the catch 17, shown at the right, interacts with the surface 18 (FIG. 3).

In the absence of an actuation of the tappet of the reading-in device, at the moment when each stop of the plate 1 is facing the catches 17, the springs 13 cause these catches to interact with the notch-shaped binding surface 19, which has the concomitant effect to angularly immobilize the plate 3, and with it the eccentric gear 2 and the connecting rod 4, and to control the catch 8 in its uncoupling by withdrawing its pawl 8*a* from the notch 7*a* into which it was engaged. This constitutes an "active" binding of the plate 3 with respect to the arm 11.

On the other hand, when an arm 11 is controlled by the tappet 16 against the corresponding spring 13, the catch 8, acted upon by the spring 10, tends to engage its pawl 8*a* into one or the other of the two notches 7*a* of the corresponding disk 7, thus causing the coupling between this disk and the eccentric gear 2 and therefore effectuating the control of the connecting rod 4 and of the heddle frame 6 with each 180° rotation of the shaft 1. In other words, in the position of FIG. 1, if the actuator 16 transmits an effective force of the tappet to the drive rod 15 of the arm 11 represented at the right, the corresponding catch 17 is released from the notch 9 and the plate 3 is driven 180° to a position in which the notch 19 interacts with the catch 17 of the opposite arm 11.

Further, in the position illustrated in FIG. 1, the binding surface 18 and the catch 17 of the arm, shown at left, interact so as to create an elastic means of immobilization of the plate 3 in its position. This elastic means of immobilization must be overcome when the plate 3 must be brought into rotation, that is to say when the pawl 8*a* engages with one of the two notches 7*a* of the disk 7. It can be considered that it is a matter of a "passive" immobilization of the plate 3.

The binding surface 18 is arranged on a radial extension 3' of the plate 3. The distance $D_1$, separating the binding surface 18, that is to say, the extremity of the extension 3' from the axis XX' of rotation of the shaft 1 is greater than the distance $D_2$ separating the notch 19 from the axis XX'. When the catch 17 of the arm 11, positioned at the left in FIG. 1, interacts with the surface 18, it is driven out in a clockwise manner in FIG. 1, to such a point that its drive rod 15 is separated from the tappet 16, so that it is out of its reach.

The functioning is as follows: In the position of FIG. 1, if it is necessary for the catch 17 of the arm 11, located at the right in FIG. 3, to be released from the notch 19 in such a manner that the pawl 8*a* of the catch 8 is driven by the spring 10 towards a notch 7*a,* the tappet 16 is oriented towards the drive rod 15 of the arm 11, located at the right in FIG. 3, so that it can exert upon it a sufficient force to overcome the restoring force of the spring 13 to which it is linked.

On the other hand, if it is not necessary to disengage the catch 17 of the arm 11, located at the right in FIG. 3, from the notch 19, the tappet 16 is oriented by the control element 16" towards the arm 11, located at the left in FIG. 3. Since it is out of reach of the tappet 16, no impact takes place between this tappet 16 and the arm 11, located at the left in FIG. 3, so that no noise is generated, and that the metal constituting the arm 11 and/or the tappet 16 is not subjected to fatigue.

It must be noted that it can be provided that the arm 17, located at the left in FIG. 1, will not be activated in this position because it interacts with a passive binding of the plate 3 in this position. In other words, it is not necessary to act upon the arm 11, located at the left in FIG. 1, because it is automatically released when the plate 3 is caused to rotate.

In FIG. 3, the plate 3 is shown after a 180° rotation with respect to its position in FIG. 1. In this position, the arm 11, located at the right in FIG. 3, is driven out by pivoting around its spindle 12 in the counter-clockwise direction, so that it is out of reach of the tappet 16. As above, if it is not necessary to act upon the arm 11, located at the left in FIG. 3, the tappet 16 is oriented towards the arm 11 located at the right in FIG. 3, and can be driven by the back and forth or "hammer" motion transmitted by the flange 16' on which it is mounted, without this motion causing a contact between the actuator 16 and one of the arms 11.

Pursuant to the known state-of-the art, it is possible to see to it that one only flange 16' can bear the assembly of the actuators used for each of the heddles of the dobby by imparting on them a back and forth motion, illustrated by the arrows F in FIGS. 1 and 3. Only the rotary drive motion, illustrated by the arrows F' in FIGS. 1 and 3, must be effectuated in an individual manner by the electromagnetic mechanisms 16" upon the actuators 16 of the dobby in accordance with the invention.

In accordance with an advantageous, but not mandatory, aspect of the invention, the geometry of the catches, that are identical since they can selectively interact with each of the binding surfaces 18 and 19, is designed in such a manner that each of them has an external bearing surface 20 and an internal baring surface 21, that are suitable to interact with the binding surfaces 19 and 18, respectively.

Figure 5:
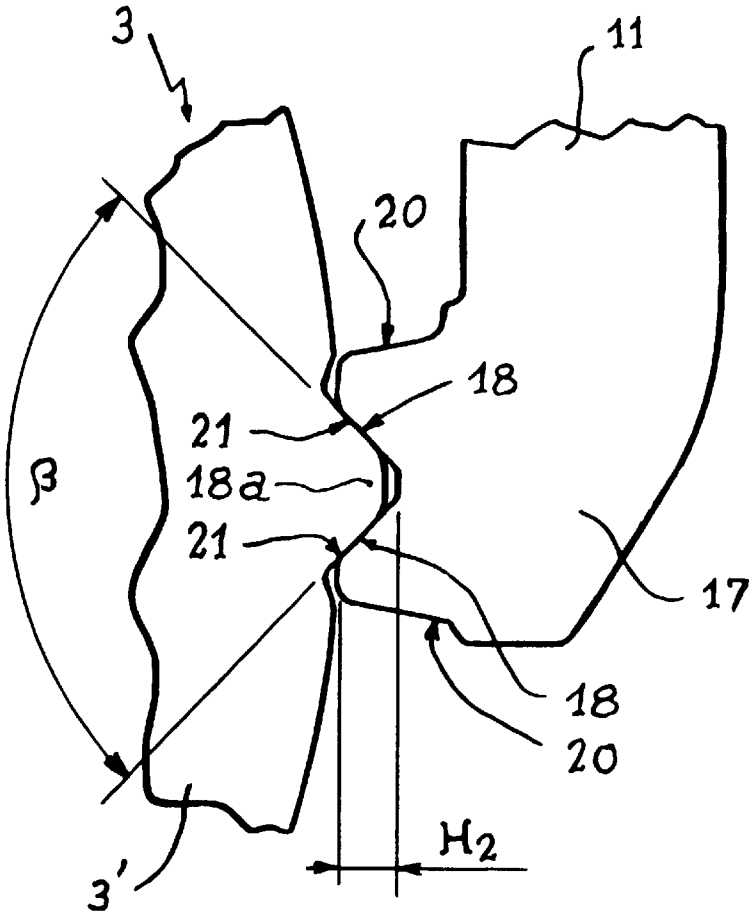
FIG. 5 is a view similar to that of FIG. 4 with an arm interacting with a portion of the plate diametrically opposed to the one illustrated in FIG. 4.
Figure 4:
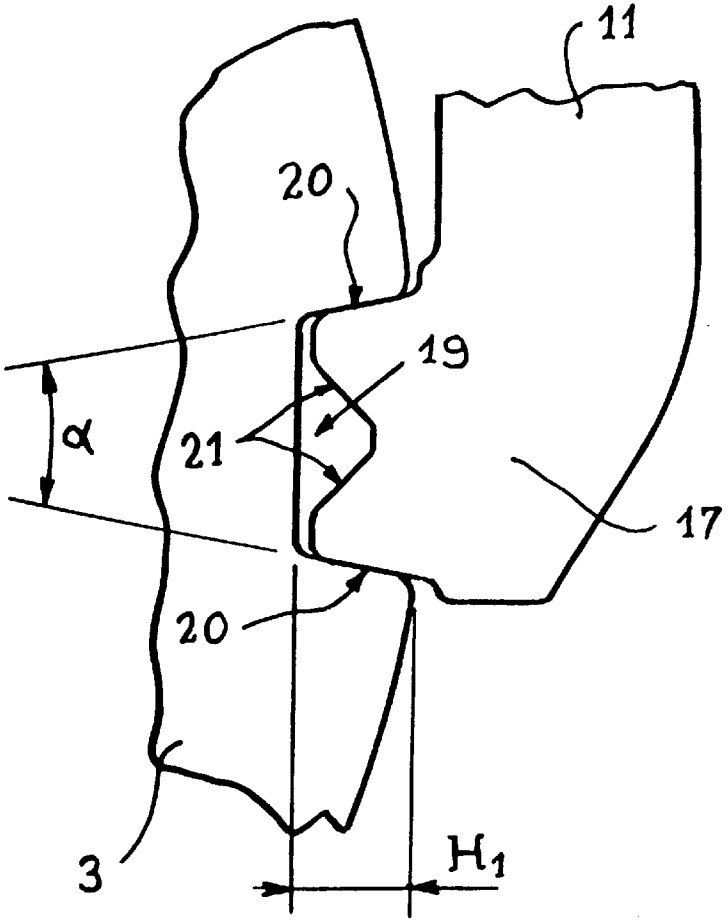
FIG. 4 shows at an enlarged scale the catch of a pivoting arm and the notch of the plate associated with one heddle in a first binding position.

The external bearing surface 20 has a geometry that is adapted to fit against the surfaces delimiting the notch 19. The vertex angle of this bearing surface 20 is reference as $\alpha$. An internal bearing surface 21 is defined sunken in the catch 17 and its vertex angle is reference as $\beta$. The geometry of the bearing surface 21 is designed so that it is suitable to fit against the external surface of a tooth 18*a* belonging to the binding surface 18, as illustrated in FIG. 5.

In can be noted that the vertex angle $\beta$ is greater than the vertex angle $\alpha$, so that it is easier to disengage the catch 17 when it interacts with the surface 18 than when interacting with surface 19, which must be related to the operating method of the dobby in accordance with the invention, in which the binding obtained with the surface 18 is "passive" while the binding obtained with the notch 19 is "active".

The bearing surface 21 has a height $H_2$ that can be different than the height $H_1$ of the bearing surface 20. It can be noted in particular that the internal bearing surface 21 is contained inside the width of the external bearing surface 20, that is to say, the height $H_2$ is less than the height $H_1$.

In accordance with a not shown variant of the invention, its design can be such that the vertex angle of the internal bearing surface 21 has a lower value than the vertex angle of the external bearing surface 20. This configuration can be used when an effective or "active" binding must be obtained for a tooth corresponding to the tooth 18 of FIG. 5, when the release of the bearing surface 20 must be facilitated. This configuration can be used when the binding surface provided with a tooth is in the proximity of the extremity of catch 8.

A loom 100 provided with a dobby of above described type can operate faster, with less energy consumption, with less wear and tear and making less noise than a weaving loom provided with a dobby of previously known type.

Furthermore, it must be understood that the above description as given only by way of example and that it does not limit at all the scope of the invention, from which one would not deviate by replacing the described design details with equivalent ones. It can be especially conceived that the invention is susceptible to be used for dobbies in which the actuating elements are not constituted by eccentric gears linked to connecting rods but by cams shaped to control roller-bearing arms coupled to the heddle frames 6. In the same manner, and although the tilting catches seem to be the most advantageous design for the movable coupling elements, one can resort to mechanisms of keys or pins having a radial displacement. Also, the movable coupling element can be constituted by several components, such as, for example, two hooks, two clasps or two keys or pins.

What we claim is:

1. A rotary dobby adapted for using in controlling the movement of a heddle from a weaving loom, comprising, an oscillating element adapted to be coupled to the heddle frame and linked to an actuating element mounted on a main shaft of said dobby, a movable coupling element pivoted relative to a plate firmly attached to said actuating element, said moveable coupling element being operatively connected to means which effects an angular connection of said plate with a disk firmly attached to said main shaft, and two pivoting arms each including a catch for cooperatively engaging a pair of spaced binding surfaces of said plate, elastic means for normally engaging said pivoting arms so that said catches are urged toward said binding surfaces of said plate, means responsive to a reading-in device for urging said pivoting arms to space said catches from said binding surfaces of said plate, said means responsive to a ready-in device including an actuator for selectively contacting said pivoting arms, and said binding surfaces being so configured such that one of said arms is out of reach of said actuator when said arms are engaged with said binding surfaces.

2. A rotary dobby in accordance with claim 1, wherein said plate is provided with a radial extension defining a first of said binding surfaces, said first binding surface being separated from an axis of rotation of said main shaft at a distance ($D_1$) that is greater than a distance ($D_2$) separating a second of said binding surfaces diametrically opposite to said first binding surface of said plate from said axis of rotation.

3. A rotary dobby in accordance with claim 2, wherein said second binding surface is formed as a notch in a periphery of said plate.

4. A rotary dobby in accordance with claim 1, wherein said catch of each of said pivoting arms has an external bearing surface and an internal bearing surface which have vertex angles ($\alpha$, $\beta$) of different values.

5. A rotary dobby in accordance with claim 1 in which said means responsive to a reading-in device includes means for supporting said actuator so as to be moveable toward and away from said pivoting arms.

6. A rotary dobby in accordance with claim 5 including a control means for pivoting said actuator about a pivot member which connects said actuator to said means for supporting said actuator whereby said actuator is moveable between one position in which said actuator is closer to a first of said pivoting arms than a second of said pivoting arms and a second position in which said actuator is closer to said second of said pivoting arms than said first of said pivoting arms.

7. A weaving loom comprising; a heddle frame, a rotary dobby including an oscillating element adapted to be coupled to said heddle frame and linked to an actuating element mounted on a main shaft of said dobby, a movable coupling element pivoted relative to a plate firmly attached to said actuating element, said moveable coupling element being operatively connected to means which effects an angular connection of said plate with a disk firmly attached to said main shaft, and two pivoting arms each including a catch for cooperatively engaging a pair of spaced binding surfaces of said plate, elastic means for normally engaging said pivoting arms so that said catches are urged toward said binding surfaces of said plate, means responsive to a reading-in device for urging said pivoting arms to space said catches from said binding surfaces of said plate, said means responsive to a reading in device including an actuator for selectively contacting said pivoting arms, and said binding surfaces being so configured such that one of said arms is out of reach of said actuator when said arms are engaged with said binding surfaces.

* * * * *